United States Patent [19]

Stacey

[11] Patent Number: 5,039,066

[45] Date of Patent: Aug. 13, 1991

[54] SAFETY FENCES

[75] Inventor: Andrew G. Stacey, Doncaster, England

[73] Assignee: British Ropes Limited, South Yorkshire, England

[21] Appl. No.: 433,333

[22] Filed: Nov. 8, 1989

[30] Foreign Application Priority Data

Nov. 8, 1988 [GB] United Kingdom ..... 8826140

[51] Int. Cl.[5] ..... E04H 17/02

[52] U.S. Cl. ..... 256/13.1; 256/47; 256/32

[58] Field of Search ..... 256/13.1, 23, 32, 40, 256/35, 37, 48, 47

[56] References Cited

U.S. PATENT DOCUMENTS

| | | | |
|---|---|---|---|
| 3,034,259 | 5/1962 | Herr | 256/32 X |
| 3,185,445 | 5/1965 | Broadway | 256/13.1 |
| 3,266,778 | 8/1966 | Wogerbauer | 256/47 |
| 3,351,322 | 11/1967 | Mueller | 256/13.1 |
| 3,353,795 | 11/1967 | Muller | 256/13.1 |
| 3,450,387 | 6/1969 | Thomas | 256/13.1 |
| 3,512,758 | 5/1970 | Thomas | 256/13.1 |
| 3,567,184 | 3/1971 | Yancey | 256/13.1 X |
| 3,722,861 | 3/1973 | Anderson | 256/37 X |
| 4,183,505 | 1/1980 | Maestri | 256/13.1 |

FOREIGN PATENT DOCUMENTS

| | | | |
|---|---|---|---|
| 1400144 | 4/1965 | France | 256/13.1 |
| 1012212 | 12/1965 | United Kingdom | 256/13.1 |
| 1103873 | 2/1968 | United Kingdom . | |

*Primary Examiner*—Peter M. Cuomo

[57] ABSTRACT

A tensioned wire cable safety fence in which two lower cables are interwoven through a row of posts, one cable passing the posts on a side opposite the other cable. The lower cables are tensioned after interweaving. Upper cables are positioned in slots formed in the top of each post and tensioned.

12 Claims, 3 Drawing Sheets

SAFETY FENCES

BACKGROUND OF THE INVENTION

1. Field of the Invention

This invention relates to safety fences designed to redirect or prevent passage of vehicles over prohibited ground and is particularly, but not exclusively, applicable to safety fences used on the sides of roads or central reservations of high-speed carriageways, roads or motorways, or embankments.

2. Review of the Prior Art

It is known that safety fences are available consisting of a number of spaced upright posts to which are clamped a number of tensioned horizontal wire ropes. It has been found that these known wire rope fences may be satisfactory when a vehicle approaches a fence at a relatively large angle of impact exceeding 20° whereas at small angles of impact below approximately 10° the vehicle may tend to spin or roll off the fence with consequent danger to the occupants of the vehicle. It is believed that one of the factors contributing to this hazard is the fact that the ropes are normally clamped to the steel posts by means of 'U' bolts or other heavy attachment devices which are strong enough to withstand the collision loading.

The disadvantage of clamping wire ropes to posts is overcome by the invention described in UK Patent No. 1,103,873 in which the tension cables are positioned as a slack fit in vertical slots in posts fixed into the ground. Tensioned cables act as a continuous beam to redirect a colliding vehicle smoothly back on to the roadway.

UK Patent No. 1,103,873 provides for a plurality of ropes supported either in slots in the top of the post or supported in brackets on either side of the post such that the cables are parallel to each other.

The testing of safety fence constructions in accordance with this patent has shown that the penetration is greater than that permitted in certain circumstances. It has also been shown that the release of the cables from the slots, whether in the posts or in the brackets, caused by the post deflection, may give rise to a situation that the cables are released too quickly or too far ahead of an impact point. This led to cables going slack too far ahead of impact and insufficient restraint for the vehicle and a danger that the vehicle will run over cable or cables lying on the ground.

The post for all the wire rope fences previously referred to have a main web and at least one flange with a cross-section, such as an 'I' section, with the main web of the section extending transversely in the direction of the cables. The post therefore has its weak axis in the direction of the fence, such that it can be more easily run down.

It is believed that the correct juxtaposition of tension cables and posts in the wire rope safety fence according to the invention met the objectives and the tests laid down by the Ministry of Transport at that time. For over 16 years such a wire rope safety fence has been used on the Pennine section of the M62 motorway and has proved to have had considerable advantages over standard type central reservation barriers, in particular they have prevented build-up of drifting snow.

SUMMARY OF THE INVENTION

It is an object of the present invention to overcome the disadvantages of the cable safety fence system described in UK Patent No. 1,103,873 and to produce better control of the action of a vehicle during impact.

Applicant's co-pending application of the same filing date relates to an alternative cable safety fence system which may be equally advantageous depending on circumstances and differing legal requirements laid down by the authorities.

According to one aspect of the present invention, a cable safety fence comprises at least one upper cable held in tension and supported by a number of posts, the posts being such to permit the upper cable to be detached from its associated post under impact, and a pair of lower cables held in tension passing around the opposite sides of selected posts whereby the lower pair of cables are also detached from the post on impact by the vehicle as the post is bent to the ground subsequent to the release of the upper cables.

Location means may be provided on each side of the post for the lower cables permitting relative motion between the posts and the cables. These locating means may be grooves formed in the post or other suitable abutments, rings or hooks.

All cables are anchored to a suitable anchoring point and tensioned to between 1,000 and 5,000 KgF. The height of the ropes above the carriageway shall be for the lower crossed ropes 450 mm to 500 mm and determined by the position of the said location means, and for the upper ropes 575 mm to 615 mm, the preferred height being 495 mm and 585 mm respectively.

A preferred method of erecting a tensioned wire cable safety fence comprises drawing a first wire cable off a reel, weaving said cable between the posts, drawing from a second reel further wire cable and weaving said further cable between the posts so that the lower cables cross each other intermediate each post, drawing from a third reel further wire cable and placing the cable in slots in the top of erected posts above the tensioned cables, and finally tethering all the cables to the ground and applying tension to the free end of the ropes.

According to yet another feature of the invention, a cable safety fence may have adjacent cable ends between posts spaced apart for vehicle access, joined by a quick-release mechanism between posts so as to provide road access through the barriers for emergencies, for example.

In another embodiment according to the invention, a corrugated tensioned beam barrier may incorporate a section or a continuation of cable safety fence anchored at one end to an end of a conventional beam barrier and tensioned. Such a corrugated tensioned beam barrier and wire rope barrier system may be provided to contain an existing corrugated beam barrier which has been damaged or to extend permanently an existing corrugated beam barrier with the improved wire rope safety fence, or to provide a safety fence in a gap in the existing corrugated beam barrier.

The posts are preferably of 'S' or 'Z' section such that the rounded corner is offered to the direction of the traffic. Such a design of post permits bending along the weaker axis, but does not provide solid restriction when a vehicle impacts the fence at 90°, since the post will twist slightly and bend on the preferred weak axis.

The posts may be located in the ground either as a driven post, i.e. a post having a plate welded to its lower section to prevent over-turning on impact, or a concrete footing which prevents over-turning of the post and allows the post to bend during impact.

The concrete footing may either be of a pre-cast design having an internal socket or opening to receive the post and thus to enable the height of the post to be set accurately on installation. Such preformed footings overcome the problem of soft ground and the difficulty of ensuring that the post is installed properly to the right depth and with the required strength of the concrete infill. In addition, when it is necessary to replace the posts because of vehicle impact, the impacted posts can be readily withdrawn and the replacement posts inserted immediately, thus facilitating re-erection of the damaged barrier in a very short period of time.

Due to the design of the safety fence, one fence on the central reservation will serve both carriageways. After an impact, repair is speedy and economical requiring damaged supports to be removed and new ones inserted, the wire ropes being re-located and possibly re-tensioned, but not necessarily replaced. Repair work could be carried out from either carriageway.

In another embodiment according to the invention, a known corrugated tensioned beam barrier may be incorporated within, or parallel with, or be a continuation of, a wire rope safety fence, such that the wire ropes can be attached to the conventional beam barrier. This may also be provided to contain deflection around existing road furniture on the central reservation which must be protected by a barrier of less deflection than the wire rope safety fence. Such a combined beam wire rope system may provide a wire rope safety fence as a first or additional barrier to be encountered by a vehicle before the corrugated beam barrier is encountered.

The posts may be of 'S' or 'Z' section and may be formed from pressed sheet steel of a thickness between 3 mm and 7 mm and adapt to deflect or distort under impact from a vehicle. The bending moment at yield of the post should be less than 6,000 Nm in its weakest plane.

The invention may be performed in various ways and a number of possible embodiments will now be described by way of example with reference to the accompanying drawings in which:

DESCRIPTION OF THE PREFERRED EMBODIMENTS

Figure 1:
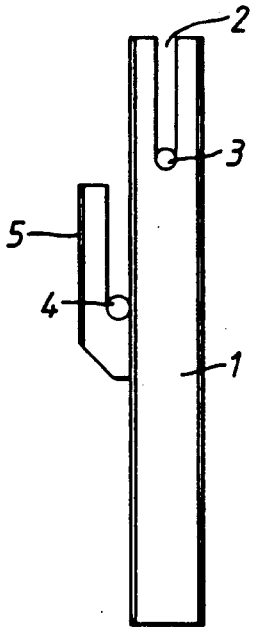
PRIOR ART Fig.1.
FIG. 1 shows a cable support post disclosed in UK Patent No. 1,103,873.

As will be seen from FIG. 1, the cable supporting post 1 has a slot 2 in the top thereof; an upper cable 3 is indicated in position at the bottom of the slot 2. A lower cable 4 is positioned at the bottom of a slot formed in a bracket 5 attached to the post 1.

The upper rope 3 and the lower rope 4 are parallel to each other and with this form of cable support, the deflection of the fence under impact is greather than now required by the Ministry of Transport. In addition, bending of the post caused by impact may release the lower and upper cables from their respective slots more or less simultaneously and thus lead to the cables being released too quickly or too far ahead from the impact point 6 causing lowering of the cable, reducing restraint further ahead and increasing the likelihood of vehicles passing over the cables.

Figure 2A:
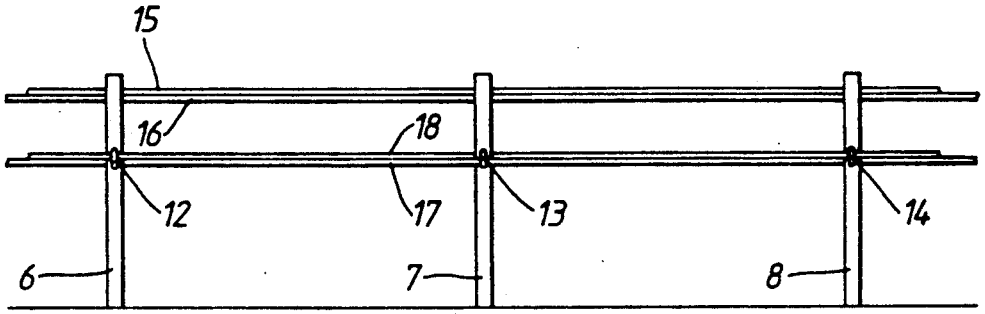
FIGS. 2A and 2B a 4-cable safety fence with the lower cables woven between the posts.
Figure 2B:
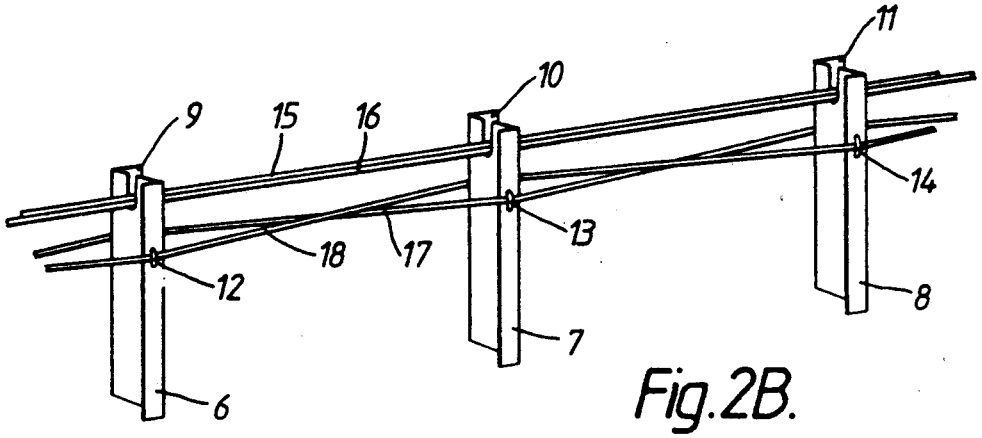
Figure 3:
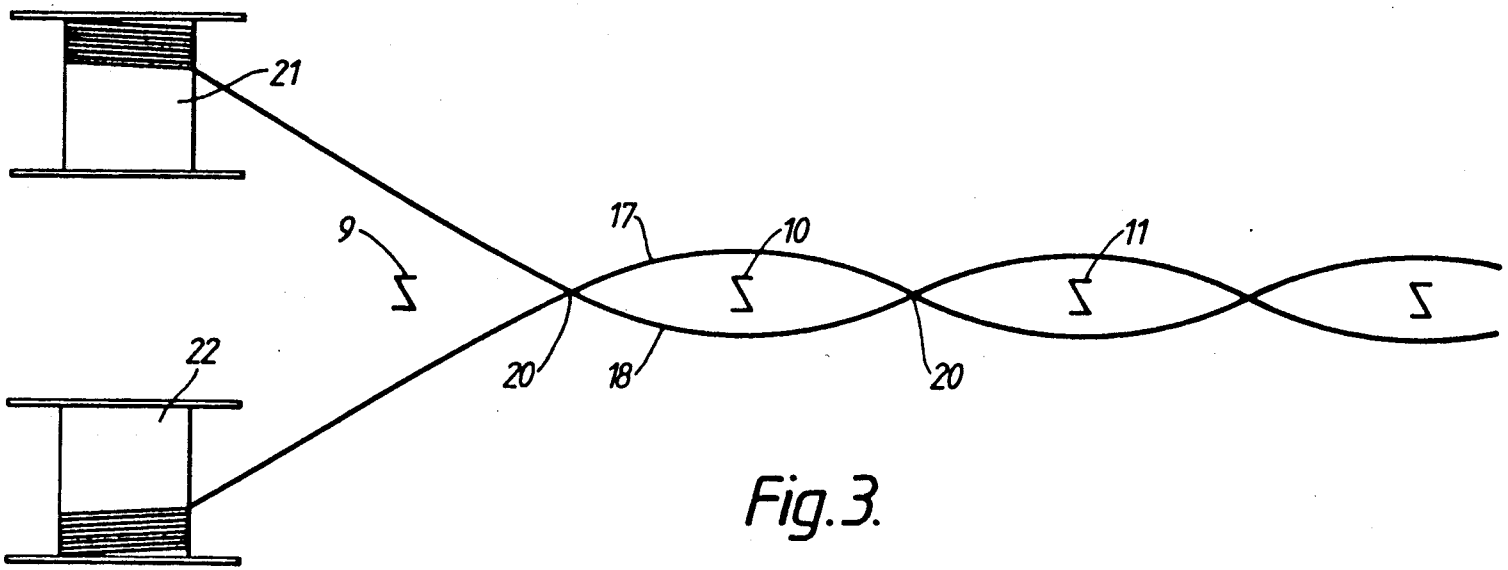
FIG. 3 shows diagrammatically the method of weaving the lower cables around the erected posts.
Figure 4:
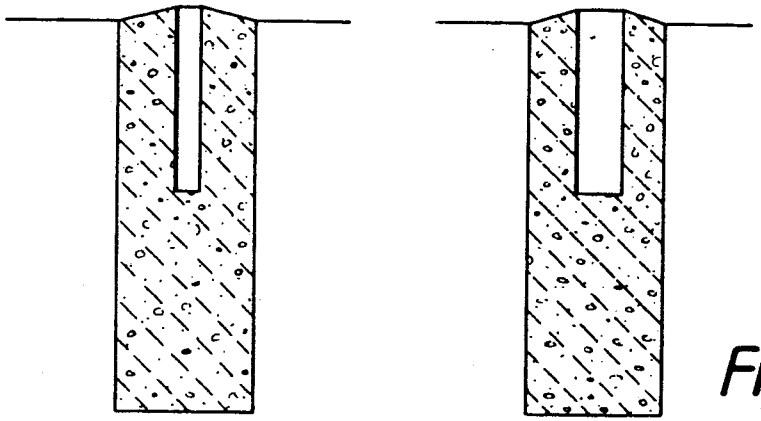
FIG. 4 shows typical pre-cast footings for the posts.

FIGS. 2 and 3 relate to the present invention. A number of posts are inserted into the ground (not shown) either into recesses in pre-cast footings or by any other suitable means. Suitable pre-cast footings are shown in FIG. 4. Other post retention means to be inserted into the ground may be used, for example, cast or pressed steel hollow tube-like structures, having a plate welded to its lower end to prevent overturning on impact, are alternatives but are not illustrated or described.

The posts 6,7 and 8 have respectively slots 9,10 and 11 formed in their upper ends. The slots are parallel-sided slots and parallel to the longitudinal edges of the posts. Similar locating means are provided on the opposite sides of the posts. Two wire ropes 15 and 16 are placed on top of one another in position into slots 9,10 and 11 and anchored to the ground and tensioned, as will be described in more detail with reference to FIG. 3. The posts 6,7 and 8 are made from steel pressings and have an 'S' or 'Z' cross-section such that a rounded corner on the line of the bend is offered to the direction of the traffic and not a sharp edge. Such a design of post permits bending along the weak axis but does not involve a solid restriction when a vehicle hits the post at 90° since the post will twist slightly and bend on the preferred weak axis.

Lower ropes 17 and 18 are woven through the posts such that the lower ropes cross as indicated at 20. Depending upon the requirements for the fence, the lower cables may now cross between each pair of posts but, for example, every two posts or every three posts. Generally speaking, crossing before and after each post provides better restraint and delays the release of the lower cables from the post until after the initial bending of the post by impact has released the upper ropes. This delay may be very significant in providing maximum restraint while limiting damage to the vehicle.

FIG. 3 shows very diagrammatically the posts 9,10 and 11 and the lower cables 17 and 18. Cable 18 is drawn off drum 21 so as to pass the side of the post 9 before crossing over to the opposite side of post 10 and then again to the opposite side of post 11. Cable 17 is drawn off the drum 22, passes along the opposite side of post 9 as compared with cable 18, and so on in sequence, so that the cables cross as indicated at 20.

The height of the ropes above the carriageway are, for the lower ropes between 450 mm and 500 mm, and for the upper ropes between 575 mm and 615 mm which, it is believed, will be suitable for restraining a typically mixed traffic flow associated with motorways. The height of the lower cables is controlled by abutments, grooves or hooks attached to the sides of the posts and are arranged so that the cable can slide along the edge of the post when positioning the ropes and when tensioning.

FIG. 4 shows cross-sections of suitable pre-cast footings which are suitable for wire cable safety fences and enable quick replacement of damaged posts. Furthermore, as compared with the posts used for tensioned beam barrier posts for cable wire fences according to the present invention, require bending above ground on impact. Posts for corrugated tensioned beam barriers are often just driven into soft ground since no bending is required on impact with the beam barrier which is just pulled out of the ground and/or fractured by impact.

Figure 5:
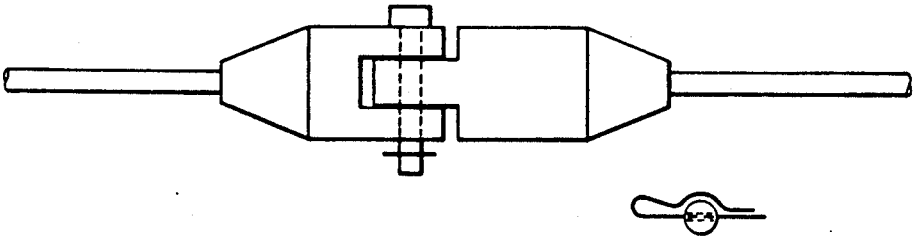
FIG. 5 shows a quick-release system to provide emergency access.

FIG. 5 shows a typical quick-release mechanism which can be utilized to join all four of the cables in a 4-wire system such that they can be disconnected to provide easy access in the case of accidents.

Figure 6:
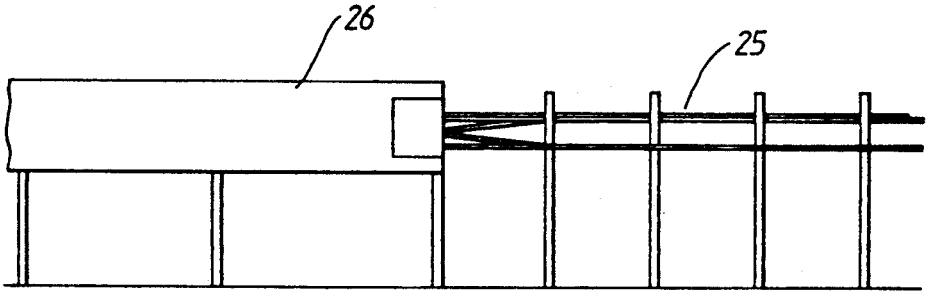
FIG. 6 shows a cable safety fence system attached at one end to a known corrugated tension beam barrier.

FIG. 6 shows how a wire rope fencing system 25 may be attached to the ends of a corrugated tensioned beam barrier 26. This enables replacement of a tensioned beam barrier when damaged or extensions of motorway where it has been decided to take advantage of the tensioned wire cable safety fence without incurring the costs of replacing the tensioned beam barrier already in place.

Figure 7:
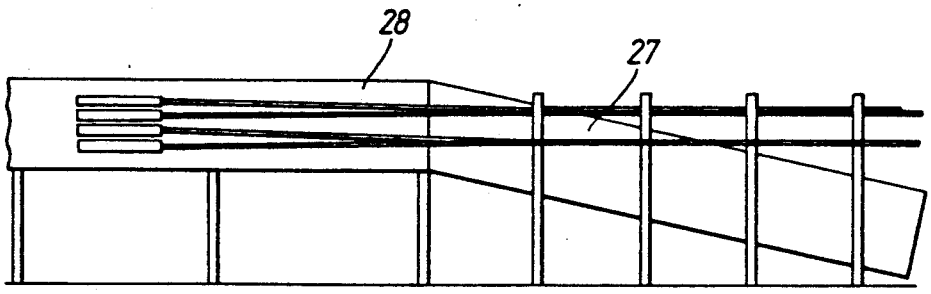
FIG. 7 shows how a cable safety fence may be used in parallel or as a first barrier with a corrugated tension beam barrier forming a second or final barrier.

FIG. 7 shows how a tensioned wire cable safety fence 27 may be placed in parallel with a tensioned beam barrier 28 so that vehicles leaving the carriageway into the central reservation will first be restrained by the cable safety fence and secondly by the final barrier formed by the tensioned beam barrier. In a similar manner, wire cable safety fences may be positioned to restrain vehicles from other road furniture, lighting and road signs, for example.

All four ropes are anchored to a suitable anchoring point and tensioned between 1,000 and 5,000 KgF. This is not described in detail and is similar to the wire rope safety fence system in UK Patent No. 1,103,873.

The manner in which the ropes are anchored, how the anchorages are staggered along the length of the fence and how the cables are restrained by tethering wires when they are severed, is well known from the practice of wire fences that are already in use.

I claim:

1. A cable safety fence comprising:

at least one upper cable held in tension and supported in slots formed in the top of a plurality of respective posts, thereby permitting the upper cable to be separated from at least one post under impact by a vehicle, each of said plurality of posts having a cross-section in the shape of a 'S' section or 'Z' section such that a rounded corner of each post faces a direction of the vehicle;

a pair of lower continuous interwoven cables held in tension along an entire length of each of said pair of cables and around the opposite sides of and crossing between selected ones of said plurality of posts; and locating means provided on the posts for positioning the pair of lower cables at a predetermined height on each of said plurality of posts, whereby the lower pair of cables are also detachable from the locating means on the at least one post upon impact by the vehicle while remaining held in tension around the post as the at least one post is bent to the ground subsequent to the release of the at least one upper cable from that one post;

wherein the combination of said at least one upper cable and said pair of lower cables substantially delays post deformation and collapse upon impact by the vehicle.

2. A cable safety fence as claimed in claim 1, wherein there are two upper cables.

3. A cable safety fence as claimed in claim 1, wherein said lower cables pass around the opposite sides of each post.

4. A cable safety fence according to claim 1, wherein adjacent cable ends between posts are spaced apart for vehicle access and joined by a quick-release mechanism between posts so as to provide road access through the barriers.

5. A cable safety fence as claimed in claim 1, wherein the cables are anchored at one end to a corrugated beam barrier.

6. A cable safety fence as claimed in claim 1, wherein each of the plurality of posts has a concrete footing which allows the post to bend during impact.

7. A cable safety fence as claimed in claim 6, wherein the concrete footing is precast and has an internal socket or opening to receive the post and thus to enable the height of the post to be set accurately on installation.

8. A cable safety fence as claimed in claim 1 arranged in parallel with a corrugated tensioned beam barrier whereby the cable safety fence forms a first barrier and the corrugated tensioned beam barrier forms a second barrier.

9. A cable safety fence as claimed in claim 1, wherein said at least one upper cable is set at a height of between 575 mm and 615 mm and the lower cables are set at a height of between 450 mm and 500 mm.

10. A cable safety fence as claimed in claim 9, wherein said at least one upper cable is set at a height of 585 mm and the lower cables are set at a height of 495 mm.

11. A cable safety fence as claimed in claim 1, wherein all cables are tensioned to between 1,000 and 5,000 Kgf.

12. A cable safety fence as claimed in claim 1, wherein each of the plurality of posts is provided with location means to determine the height of the lower cables.

* * * * *